US006048122A

United States Patent [19]

Ohba

[11] Patent Number: 6,048,122

[45] Date of Patent: Apr. 11, 2000

[54] CONTAINER FOR FEEDING A STICK TYPE COSMETIC MATERIAL

[75] Inventor: Atsushi Ohba, Tokyo, Japan

[73] Assignee: Suzuno Kasei Kabushiki Kaisha, Japan

[21] Appl. No.: 09/366,475

[22] Filed: Aug. 3, 1999

[30] Foreign Application Priority Data

Aug. 5, 1998 [JP] Japan ..... 10-232391

[51] Int. Cl.[7] ..... B43K 21/027

[52] U.S. Cl. ..... 401/55; 401/68; 401/75

[58] Field of Search ..... 401/55, 68, 73–75, 401/86, 87

[56] References Cited

U.S. PATENT DOCUMENTS 5,879,093 3/1999 Ohba et al. ..... 401/68

FOREIGN PATENT DOCUMENTS 60-33919 1/1985 Japan .

*Primary Examiner*—Henry J. Recla
*Assistant Examiner*—Huyen Le
*Attorney, Agent, or Firm*—D. Peter Hochberg; William H. Holt

[57] ABSTRACT

In a container for feeding a stick type cosmetic material which houses the stick type cosmetic material in such a manner that the material can be fed, a cylinder (9) is unrotatably housed in a main body of the container (3) and also a plurality of projections (7) provided at an outer circumference of a push rod (6) are engaged with spiral grooves (11) provided at an inner circumference of the cylinder (9). A cosmetic material (5) is held by a plurality of claws (4*a*) which are provided at a front end of the push rod (6). Projections (7*a*) which have advanced upward and got out of the cylinder (9) are engaged with grooves (8) in which the claws (4*a*) slide and a whirl of a front cylinder (2) and the push rod (6) is stopped. A stopper (10) is provided at a lower end of the push rod (6). An uppermost limit of a stroke of the push rod (6) is defined by bringing an upper end surface (10*a*) of the stopper into contact with a lower end surface (9*b*) of the cylinder, and a lowermost limit of a stroke is defined by bringing a lower end (10*b*) of the stopper into contact with a bottom surface (3*b*) of the main body of the container.

9 Claims, 15 Drawing Sheets

CONTAINER FOR FEEDING A STICK TYPE COSMETIC MATERIAL

FIELD OF THE INVENTION

The present invention relates to a container for feeding a stick type cosmetic material which houses a cosmetic material having a small diameter, such as a lip-liner or eye-liner, in such a manner that the material can be fed.

BACKGROUND OF THE INVENTION

There are a method of pouring a liquid material into the mold of a cosmetic material container and a method of extrusion molding as a conventional method of manufacturing a cosmetic material having a small diameter. In the pouring method among these methods, since a section of housing a cosmetic material (a front cylinder) of the cosmetic material container is a mold of the cosmetic material, a shape of the container is restricted and the cosmetic material may be broken due to its weak strength. Therefore, the cosmetic material having a small diameter is generally manufactured by the method of extrusion molding.

The container is equipped with a cup-shaped chuck as a holding section of the cosmetic material. If a cosmetic material manufactured by the method of extrusion molding is held by such a chuck, a gap equivalent to a thickness of the chuck will arise between the cosmetic material and a surface of an inner circumference of the front cylinder. Thus, it is impossible for the cosmetic material in the front cylinder to be supported from a side face. Therefore, in order to prevent the cosmetic material from breaking, an opening bore diameter of the front cylinder has to be almost same as an outer diameter of the cosmetic material, and the cosmetic material has to be large in diameter so that it will be hard to break. Also, it is possible to use a cosmetic material whose portion to be fitted to the chuck is formed to have a small diameter, but such a cosmetic material is expensive.

Under the circumstances, Japanese Utility Model Laid-Open Publication No. Sho 60-33919 discloses a container having a claw type chuck as shown in FIGS. 16 and 17.

As shown in the drawings, in a container 101, a front cylinder 102 maintains a uniform inner diameter in the direction of a shaft and four grooves 104 are formed on a surface of the inner circumference of the front cylinder 102. A chuck 105 fitted to the front end of a push rod 108 has four claws 105*a*. These four claws 105*a* are engaged with the four grooves described above, respectively. A cosmetic material has a diameter which is slightly smaller than an inside diameter of the front cylinder 102, and a base end of the cosmetic material 103 is held by the four claws 105*a*.

Due to such constitution, the cosmetic material 103 is always supported in a direction of an entire shaft by a slide section 102*c* provided on an inner surface of the front cylinder. Therefore, even though the cosmetic material 103 bends resulting from temperature, humidity, or the like, the bend is modified by the slide section 102*c*.

Projections 107 at a base end of the push rod 108 are engaged with spiral grooves 106 on a surface of the inner circumference of a main body of the container 109. Thus, by rotating the front cylinder 102 and the main body of the container 109 rotate relative to each other, the push rod 108 advances or retracts in the direction of a shaft and the cosmetic material 103 advances from or retracts to an opening bore 102*a*.

However, the container 101 described above has following disadvantages.

First, in this constitution, an excessive load is imposed on the claws 105*a*.

To be concrete, at the feeding uppermost limit of the push rod 108, upper ends of the claws 105*a* come in contact with upper ends 104*a* of the grooves 104. Since a whirl-stop operates on the chuck 105 and the front cylinder 102 due to the engagement of the claws 105*a* with the grooves 104, if the front cylinder 102 is caused to make a further rotation after reaching the feeding uppermost limit, torque operates on the claws 105*a*.

Since the claws 105*a* do not have enough strength, they easily deform when excessive torque is imposed. As a result, there is a possibility that the cosmetic material 103 held by the claws 105*a* is damaged. Further, since the front cylinder 102 is pushed upward at the feeding uppermost limit by the claws 105*a*, there is a case that the front cylinder 102 detaches itself from the main body of the container 109.

Second, it is difficult to change a feeding stroke of the cosmetic material, thereby leading to higher manufacturing costs.

Containers are sometimes manufactured for a series of cosmetic materials. In this case, cosmetic materials of different kind differ in nature, such as hardness. Thus, length of the cosmetic material, a feeding stroke, or the like has to be changed at every cosmetic material, for example, in such a manner that a hard cosmetic material is shorten. However, the constitution of the container 101 makes it difficult to change a feeding stroke or the like. Consequently, it is difficult to unify shapes of the containers in a series of cosmetic materials. Further, unification of the shapes of the containers is accompanied with problems, such as an increase in the number of parts or the like, whereby manufacturing costs are increased.

SUMMARY OF THE INVENTION

An object of the present invention is to provide a container for feeding a cosmetic material which does not impose a burden on claws which constitute a section of holding the cosmetic material.

Another object of the present invention is to provide a container that is capable of easily changing length of a cosmetic material to be housed or a feeding stroke.

In order to achieve above the objects the present invention provides a container for feeding a stick type cosmetic material.

A container for feeding a stick type cosmetic material comprising: a front cylinder in which a stick type cosmetic material is housed in such a manner that the material can advance and retract and a plurality of longitudinal grooves are formed on its inner surface; a main body of the container to be rotatably connected to the front cylinder; a push rod, which has at its front end a plurality of claws capable of sliding in said grooves, for holding said stick type cosmetic material; a spiral cylinder, non-rotatably provided in said main body of the container, in which said push rod runs through in a state of being spirally engaged; a plurality of projections which are spirally engaged with spiral grooves provided on an inner surface of said spiral cylinder and provided at an outer circumference of said push rod in such a manner that the projections are lined up below said claws; a whirl-stop mechanism for engaging said longitudinal grooves with said projections which have advanced upward and got out of said spiral cylinder and stopping a whirl of said push rod and said front cylinder; and a stopper for defining an uppermost limit of a stroke of said push rod by contacting, in the vicinity of a lower end of said push rod, a lower end surface of said spiral cylinder.

The details as well as other features and advantages of the invention are set forth in the remainder of specification and are shown in accompanying drawings.

DESCRIPTION OF THE PREFERRED EMBODIMENTS

FIG. 1 through 6 show a container for feeding a stick type cosmetic material 1 according to an embodiment of the present invention.

Figure 1:
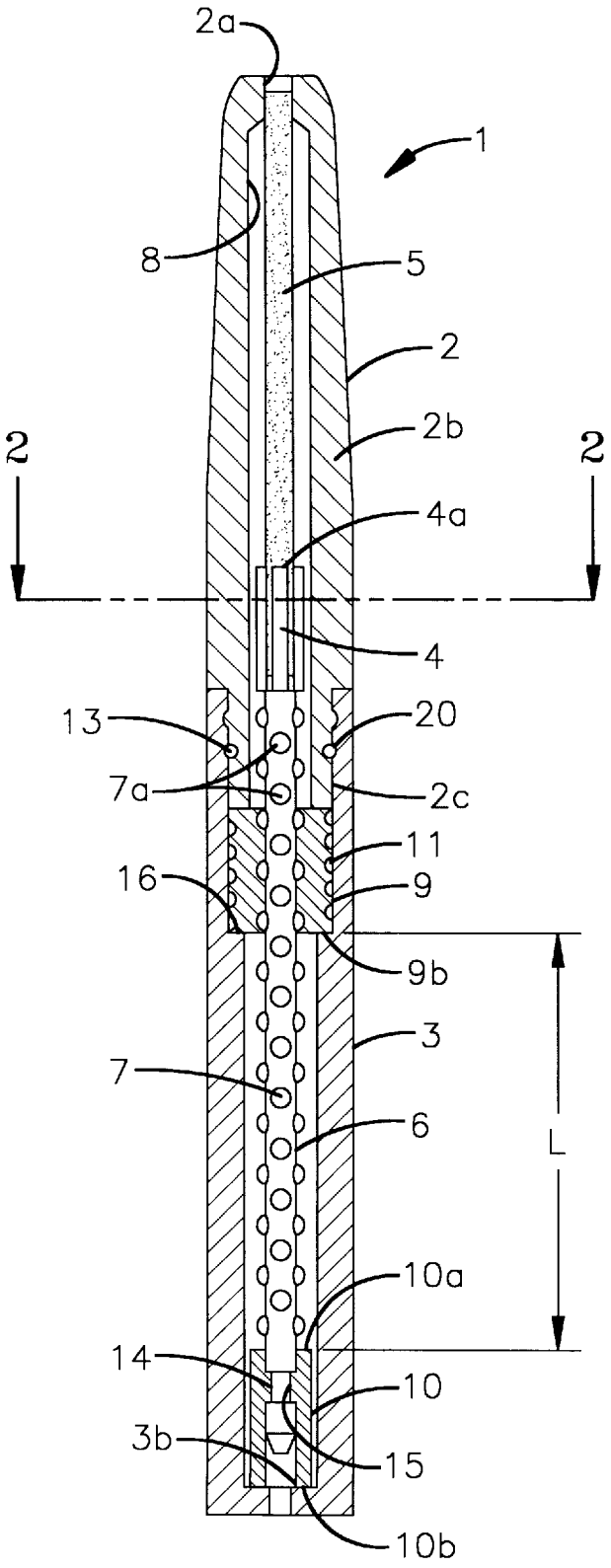
FIG. 1 is a sectional view showing a container according to a first embodiment.

As shown in FIG. 1, the container 1 is composed of a front cylinder 2, a main body of the container 3, a cosmetic material 5, a push rod 6, a cylinder 9, and the like.

The front cylinder 2 is composed of an exposed section 2*b* and a rotary section 2*c*. An upper end of the exposed section 2*b* is equipped with an opening bore 2*a* which the cosmetic material 5 advances from and retracts to. The rotary section 2*c* is housed in the main body of the container 3. The rotary section 2*c* is rotatably fitted to the main body of the container 3 by irregularity engagement. An O-ring 13 is fitted to a peripheral groove 20 of the rotary section 2*c*, and frictional resistance arises between the rotary section 2*c* and the main body of the container 3.

The cosmetic material 5, such as an eye-liner, a lip-liner, or the like, is housed inside the front cylinder 2. A lower end of the cosmetic material 5 is held by a plurality of claws 4*a* of a holding section 4. The holding section 4 is formed at a front end of the push rod 6. Each of the claws 4*a* of the holding section 4 can slide in grooves 8 which are formed on an inner surface of the front cylinder 2.

The cylinder 9 is installed at a stage which is formed on an inner surface of the main body of the container 3. Streaks 12 are formed on an outer surface of the cylinder 9. The streaks 12 are non-rotatably engaged with knurls 17 which are formed on an inner surface of the main body of the container 3. Spiral grooves 11 are formed on an inner surface of the cylinder 9.

If a pitch of the grooves 11 is large, it will be possible to easily rotate and take out the cylinder 9 formed from a metal mold by a stripper method or the like.

Figure 4:
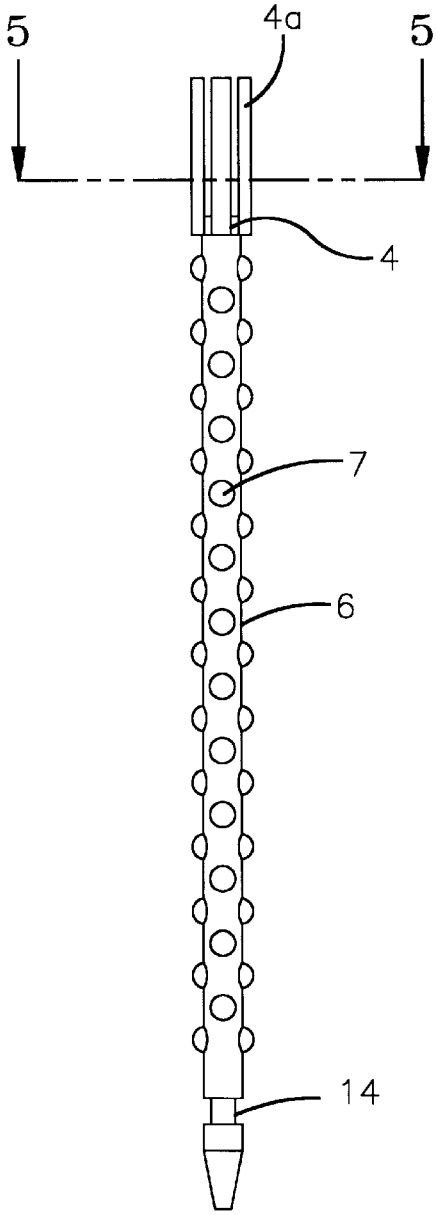
FIG. 4 is a front view showing a push rod.
Figure 5:
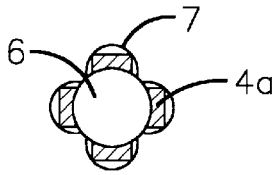
FIG. 5 is a sectional view along its B—B line in FIG. 4.

As shown in FIGS. 4 and 5, a plurality of projections 7 is formed at an outer circumference of the push rod 6. These projections 7 are lined up below each of the claws 4*a* provided at an upper part of the push rod 6, and they also have the same spiral orbit as that of the grooves 11 of the cylinder 9. The push rod 6 penetrates the cylinder 9 and is housed in the container 1. Thus, a part of the plurality of projections 7 at the outer circumference of the push rod 6 is engaged with the grooves 11 of the cylinder 9. Due to such constitution, when the front cylinder 2 and the main body of the container 3 are rotated, the push rod 6 and the cylinder 9 are rotated, the projections 7 advance along the grooves 11, and the push rod 6 is fed. In other words, the cylinder 9 and the projections 7 formed at the outer circumference of the push rod 6 constitute a feeding mechanism.

The projections 7*a* located above the cylinder 9 are engaged with the grooves 8 which are provided in the front cylinder 2. Thus, projections 7*a* fulfill a function of the whirl-stop of the front cylinder 2 and the push rod 6. More specifically, when the projections 7 advance upward and get out of the grooves 11, the projections 7 become the projections 7*a* and their role changes from components of the feeding mechanism to components for a whirl-stop.

It is arranged such that a width of each of the claws 4*a* is equal to or narrower than that of the projections 7 of the push rod 6. Thus, pressures from right and left are absorbed by the projections 7*a*, whereby the pressures do not operate on the claws 4*a*.

Figure 6:
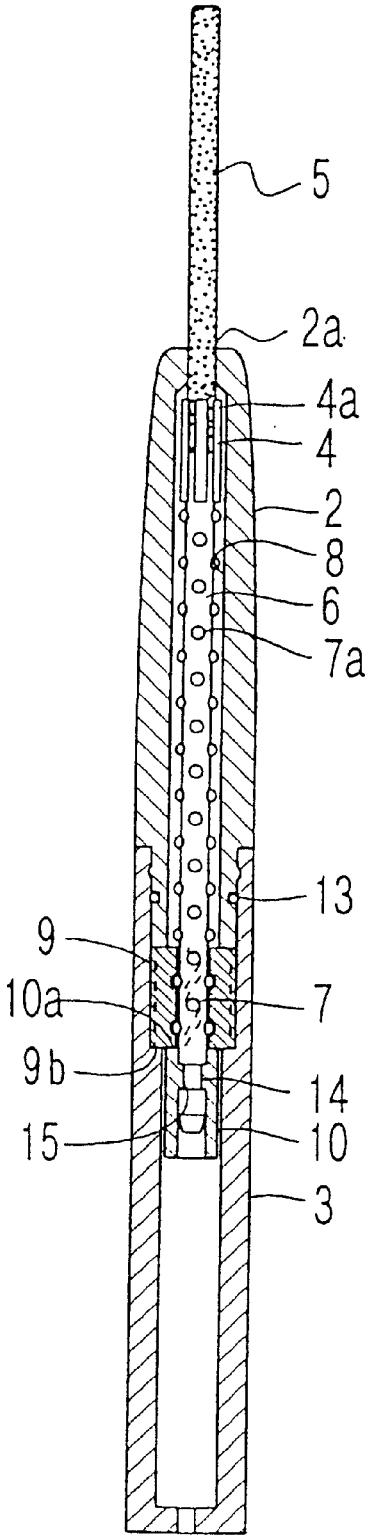
FIG. 6 is a sectional view showing a feeding uppermost limit of the push rod of the container.

A stopper 10 is equipped at a lower end of the push rod 6. A convexity 15 is formed on an inner surface of the stopper 10, and by engaging the convexity 15 with a concavity 14 which is provided near the lower end of the push rod 6, the stopper 10 is fitted to the lower end of the push rod 6. An uppermost limit and a lowermost limit of the feeding stroke of the container 1 are defined by the stopper 10. More specifically, as shown in FIG. 6, a location where an upper end surface 10*a* of the stopper 10 contacts a lower end surface 9*b* of the cylinder 9 resulting from an advance of the push rod 6 is defined as the uppermost limit of the feeding stroke. Also, a location where a lower end 10*b* of the stopper 10 contacts a bottom surface 3*b* of the main body of the container 3 resulting from retraction of the push rod 6 is defined as the lowermost limit of the feeding stroke.

Length L of the feeding stroke can easily be changed by changing the stopper 10 without changing other components.

Figure 7:
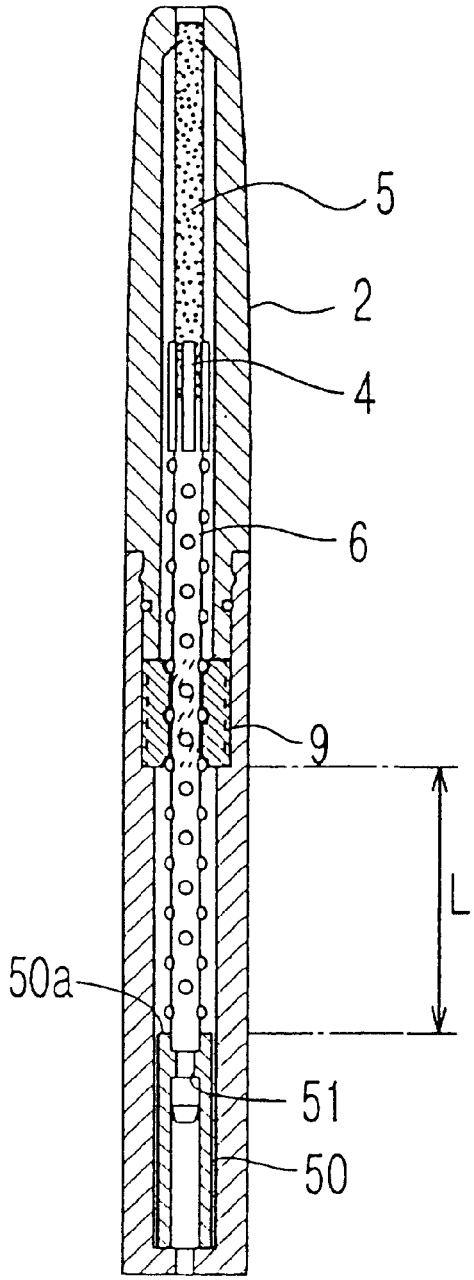
FIG. 7 is a sectional view showing the container in which a stopper is changed.

As shown in FIG. 7, by adopting a stopper 50 which is long in a longitudinal direction and placing an upper end surface 50*a* of the stopper 50 at a high position at the lowermost limit of the feeding stroke, the length L of the feeding stroke can be shorten.

The push rod 6 can be provided at a high position at the lowermost limit of the feeding stroke by installing a convexity 51 of the stopper 50 at a high position. Thus, with the external form of the container 1 kept to be identical, it is possible to adapt the container 1 to a short cosmetic material 5.

Thus, according to this embodiment, by changing the stopper, length of the cosmetic material 5 and length of the feeding stroke can easily be changed in the container 1 having an identical external form.

The O-ring 13 is fitted between the rotary section 2*c* of the front cylinder 2 and the main body of the container 3. Due to frictional resistance applied to the rotation of the front cylinder 2 and the main body of the container 3 by the O-ring 13, it is possible to prevent occurrence of a phenomenon which the cosmetic material 5 falls in the container 1 due to a pressure at the time of using the cosmetic material 5. This is effective for a case that a pitch of the grooves 11 is enlarged. Further, since the O-ring 13 gives an appropriate resistance to the rotation of the front cylinder 2 and the main body of the container 3, customers can substantially sense the advance and retraction of the cosmetic material when they operate.

In order to have high efficiency and productivity in assembling the container 1, it is preferable to adopt the following assembling method.

Figure 3:
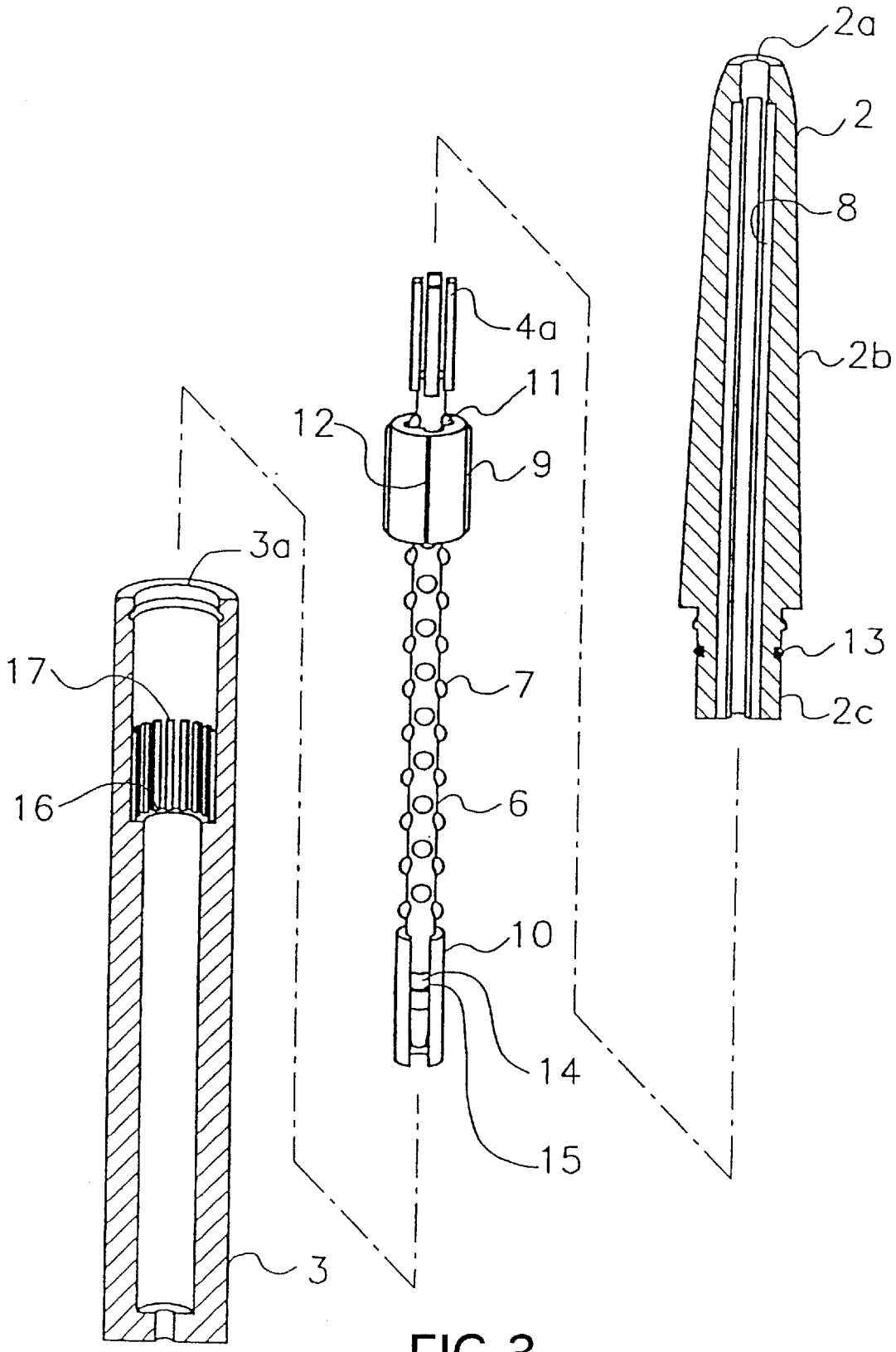
FIG. 3 is an disassembled perspective view showing a container which is taken apart to a unit, a front cylinder, and a main body of the container.

As shown in FIG. 3, a total of three members, such as the cylinder 9, the push rod 6, and the stopper 10, which are manufactured separately from the main body of the container 3 are assembled so as to form a unit. The unit is then assembled into the main body of the container 3 by insertion.

To be precise, first, the projections 7 provided at an outer circumference of the push rod 6 are engaged with the grooves 11 provided on an inner surface of the cylinder 9 and at the same time the push rod 6 is run through the cylinder 9. The convexity 15 of the stopper 10 is then fixed into the concavity 14 which is provided near a lower part of the push rod 6 so that the unit is assembled.

Subsequently, the unit is inserted into an opening bore 3*a* of the main body of the container 3 from the stopper 10 side. Thus, the cylinder 9 is arranged in the main body of the container 3 and also the streaks 12 provided at an outer circumference of the cylinder 9 are engaged with knurls 17 provided at an inner circumference of the main body of the container 3.

Finally, the container 1 is completed by fixing the cylinder 2 into the main body of the container 3 carrying out alignment of the grooves 8 and claws 4*a*.

Next, the operation will be described.

When the container 1 is used, the front cylinder 2 is rotated with the main body of the container 3 being supported. In this case, since whirl-stop operates on the front cylinder 2 and the push rod 6 due to the engagement of the projections 7*a* of the push rod 6 with the grooves 8 of the front cylinder 2, the push rod 6 and the cylinder 9 rotate relative to each other. Therefore, the projections 7 of the push rod 6 which are spirally engaged with the grooves of the cylinder 9 advance along the grooves 11 and the push rod 6 advances upward. Each of the claws 4*a* provided at a front end of the push rod 6 moves upward in the groove 8. Thus, the cosmetic material 5 held at the holding section 4 is fed from the opening bore 2*a* of the front cylinder 2.

As shown in FIG. 6, feeding of the cosmetic material 5 is regulated by the contact of the upper end surface 10*a* of the stopper 10 with the lower end surface 9*b* of the cylinder 9.

At the uppermost limit of the feeding stroke, most of the projections 7 at an outer circumference of the push rod 6 advance upward and get out of the cylinder 9, and they become the projections 7*a* which function as whirl stoppers. Thus, even though a customer attempts to rotate the front cylinder 2 and the main body of the container 3 with his or her further strength after the feeding stroke reaches the uppermost limit, torque is depressively absorbed by a large number of projections 7*a* extend over a wide area in the direction of a shaft of the push rod, whereby kinks of the push rod 6 will not arise so easily. Therefore, it is possible to prevent occurrence of a phenomenon which due to a kink of the push rod 6, the claws 4*a* are damaged, the cosmetic material is detached from the claws 4*a*, or the like.

Since a force to feed the push rod 6 upward along the cylinder 9 is absorbed by the cylinder 9 via the stopper 10 at the uppermost limit of the feeding stroke, the force does not operate on other members. Therefore, even though the user attempts to rotate furthermore the front cylinder 2 and the main body of the container 3 at the uppermost limit of the feeding stroke, the front cylinder 2 is not detached from the main body of the container 3.

On the other hand, in order to house in the container 1 the cosmetic material 5 which has been fed, the main body of the container 3 and the front cylinder 2 are rotated in a direction opposite to the direction at the time of feeding. Thus, the cosmetic material 5 retracts downward.

Figure 2:
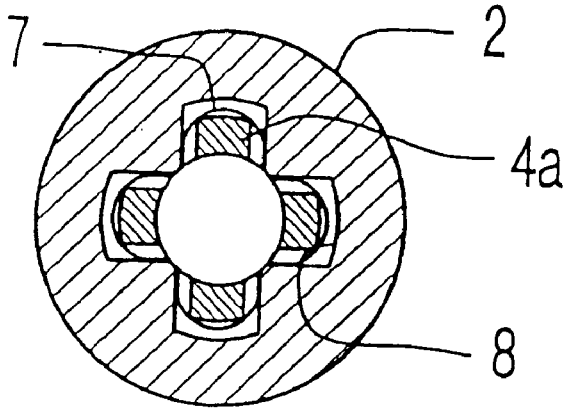
FIG. 2 is a sectional view along its A—A line in FIG. 1.
Figure 8:
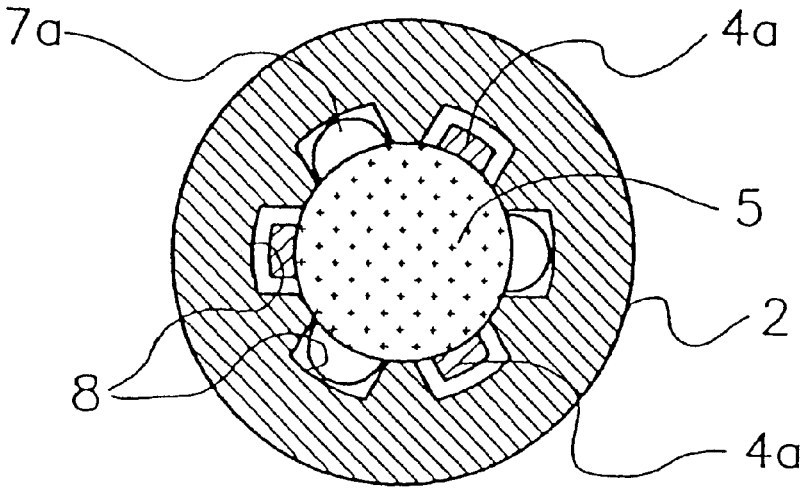
FIG. 8 is a sectional view showing a case that grooves are separated into grooves which projections are engaged with and grooves in which claws slide.

As shown in FIG. 8, it is all right to have constitution such that the claws 4*a* of the push rod 6 and the projections 7 are installed apart and the grooves 8 on an inner surface of the front cylinder 2 are composed of separate grooves, such as grooves which are engaged with the projections 7*a* and grooves in which the claws 4*a* slide. However, as shown in FIG. 2, if a single groove 8 has both functions, such as engagement with the projections 7*a* and slide of the claws 4*a*, it will be possible to design the wider claws 4*a*. This is advantageous for securing an area in which the cosmetic material 5 is held.

Figure 9:
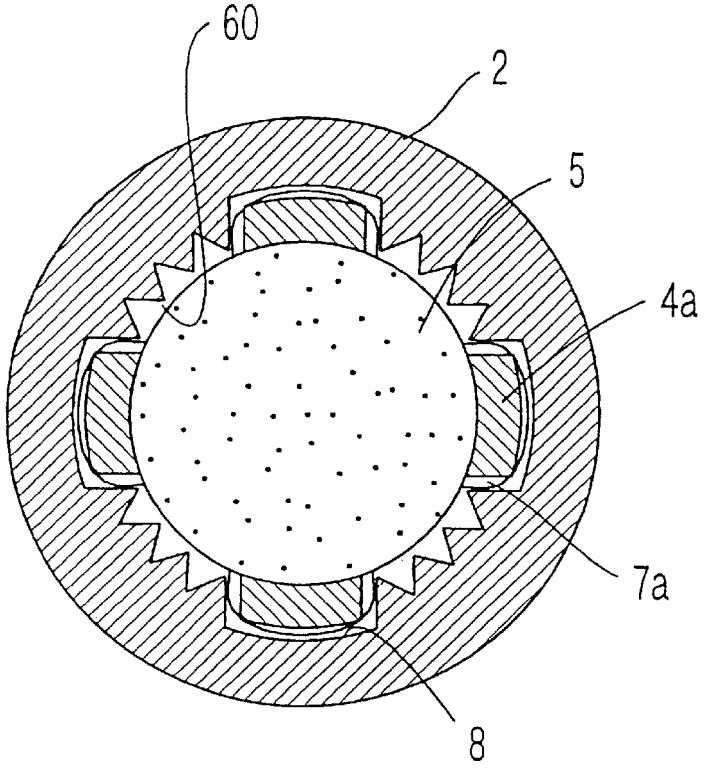
FIG. 9 is a sectional view showing a case that a knurl slide section is formed on an inner wall of the front cylinder.

As shown in FIG. 9, slide sections between the grooves 8 which adjoin each other may be used as slide sections 60 to which knurling is applied in the direction of a shaft. Thus, even though an area where the slide sections 60 and the cosmetic material 5 come in contact with each other is minimum, sufficient support can be given to the cosmetic material 5 from a side. By minimizing the contact area between the slide sections 60 and the cosmetic material 5 as described above, it is possible to minimize a cut of the cosmetic material 5 resulting from a contact with the slide sections 60 at the time of a stroke or resistance by the slide sections.

Figure 10:
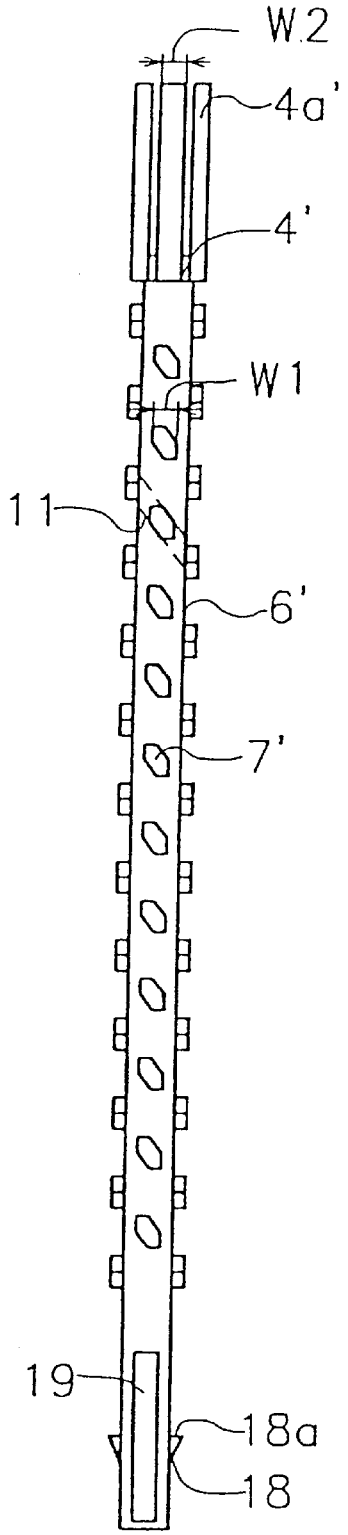
FIG. 10 is a front view showing a push rod of the container according to a second embodiment.

The push rod 6 can be the push rod 6' shown in FIG. 10. The push rod 6' and the push rod 6 differ in two points as follows.

First, the push rod 6' has a bend piece 18, which is formed as one united body with the push rod 6', as a stopper section in place of the removable stopper 10.

The bend piece 18 is formed near a lower end of the push rod 6', and an upper end surface 18*a* of the bend piece 18 contacts the lower end surface 9*b* of the cylinder 9 at the uppermost limit of the feeding stroke. Thus, the bend piece 18 functions as a stopper section which defines the uppermost limit of the feeding stroke.

On the other hand, when assembling the cylinder 9, the bend piece 18 is run through the cylinder 9 from a lower end side. At this time, an inclined surface at a lower part of the bend piece 18 is pushed to an inner wall of the cylinder 9 and the bend piece 18 is bent to a cavity 19 side. Thus, assembling of the push rod 6' and the cylinder 9 can be facilitated. Therefore, if the push rod 6' is adopted, it will be possible to simplify an assembling process of the unit which is composed of the push rod 6' and the cylinder 9. However, the cavity 19 for a bend of the bend piece 18 has to be formed at the push rod 6', and therefore a diameter of the push rod 6' becomes slightly large. Therefore, the adoption of the push rod 6' is suitable for the case which a diameter of the cosmetic material 5 to be used is slightly large.

Second, projections 7' of the push rod 6' are inclined in a direction along the grooves 11 of the cylinder 9. Thus, a width W1 of the projections 7' can be wide. Therefore, a width W2 of the claws 4*a* of a holding section 4' can also be wide, and an area of holding the cosmetic material 5 can be large.

Figure 11:
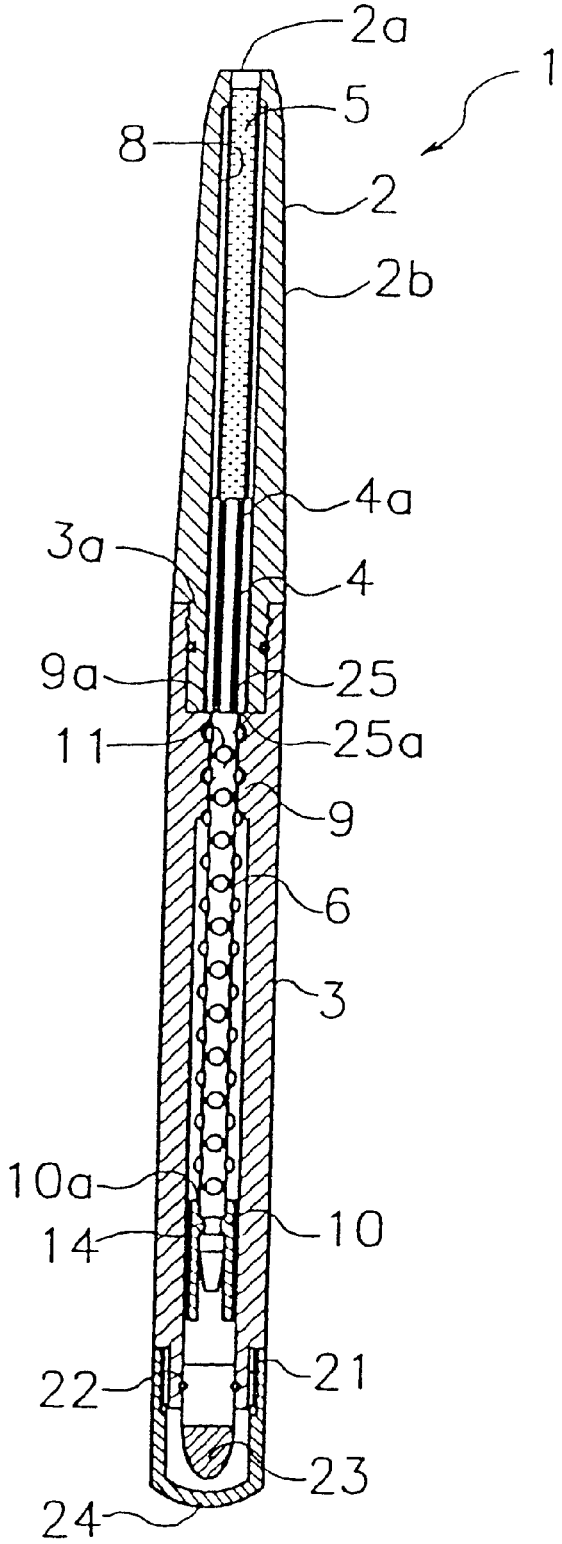
FIG. 11 is a sectional view showing the container according to a third embodiment.

FIG. 11 shows a container according to a third embodiment of the present invention.

In this embodiment, as compared with the embodiment shown in FIG. 1 to 6 described above, there are the following two different points. The first different point is that the push rod 6 has streaks 25, extending in the direction of a shaft, below the claws 4*a* of the holding section 4. Also, the second different point is that the cylinder 9 is formed as one united body with the main body of the container 3.

The streaks 25 are formed in width which is equal to or wider than that of the projections 7, and they function as members for a whirl-stop which are engaged with the grooves 8 similarly to the case of the projections 7.

Since the streaks 25 are provided, a lower end surface 25*a* of the streaks 25 contacts an upper end surface 9*a* of the cylinder 9, whereby the contact point is defined as the lowermost limit of the stroke of the push rod 6. Therefore, it is not necessary for the main body of the container 3 to be equipped with a bottom surface to contact a lower end of the stopper 10, whereby a lower part of the main body of the container 3 can be open. Even though a lower end surface 25*a* of the streaks 25 contacts an upper end surface 9*a* of the cylinder 9, deformation does not arise at the claws 4*a* which are provided above the streaks 25 because the streaks 25 are fixed to a side surface of the push rod 6.

By providing a lower part of the main body of the container 3 with an opening, it is possible to form the main body of the container 3 with which the cylinder 9 is formed as one united body.

It is also possible to fix parts 23, such as a chip and a brush, into the opening at a lower part of the main body of the container 3 through an O-ring 22. Further, by forming a knurl section 21 at an outer circumference of the lower end of the main body of the container 3 and installing a cap 24 to be fitted to the knurl section 21 by engagement, user friendliness can be achieved.

FIGS. 12 to 15 show a fourth embodiment according to the present invention.

This embodiment differs from the embodiment shown in FIG. 11 in that pinholes 71 are formed at the push rod 6 and a pin 72 can be fixed into the respective pinholes 71.

A plurality of pin holes 71 are provided at about the center of the projections 7 arranged side by side in the direction of a shaft and penetrate the push rod 6 horizontally. The pin 72 is fixed into any one of the pinholes 71. In this case, a convexity 72*a* formed at an outer circumference of the pin 72 is fitted into a concavity 7 la formed at an inner circumference of the pinhole 71, and the pin 72 is fixed in the pinhole 71.

Figure 15:
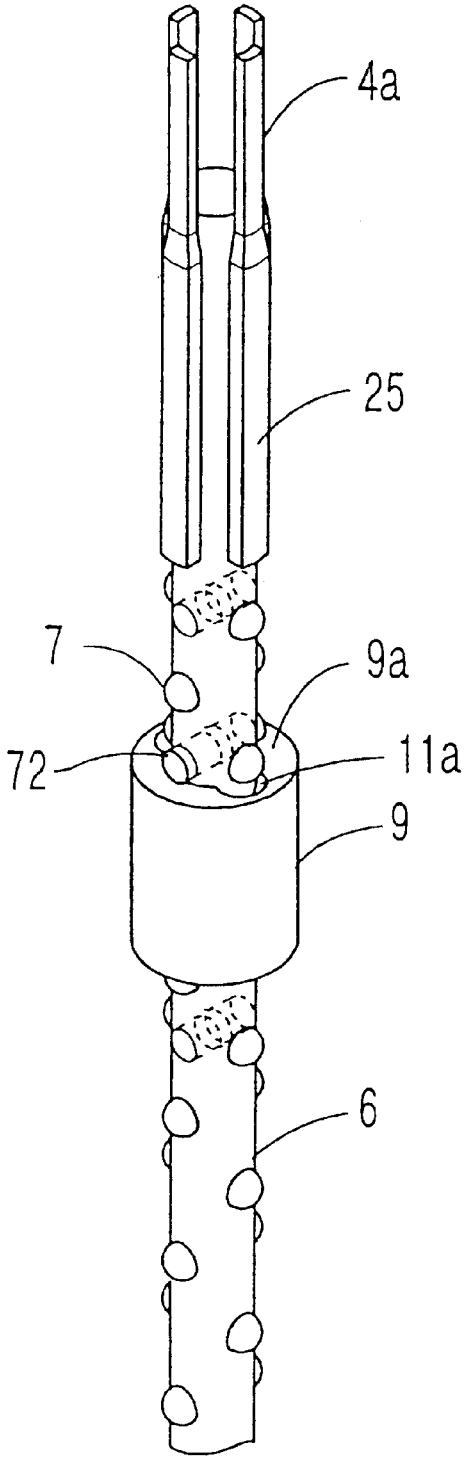
FIG. 15 is a perspective view showing a state that the pin fixed into the push rod contacts a surface of the upper end of a cylinder.
Figure 16:
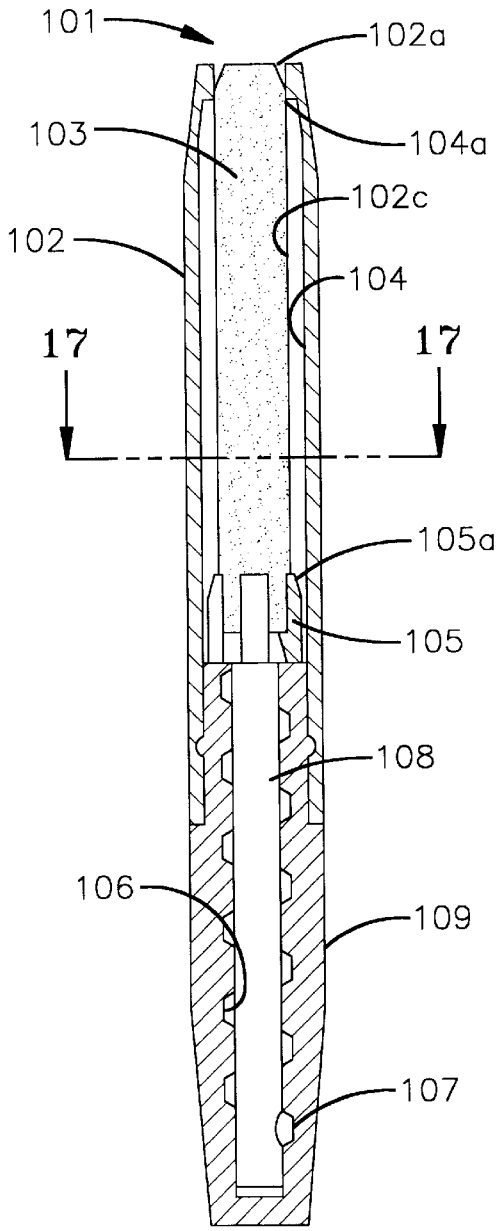
FIG. 16 is a sectional view showing a conventional container.
Figure 17:
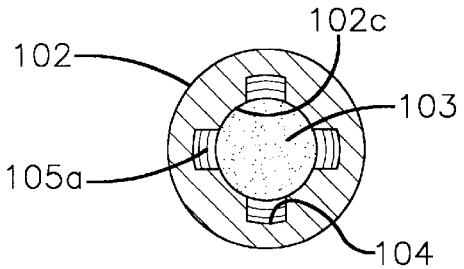
FIG. 17 is a sectional view along its C—C line in FIG. 16.

The pin 72 thus fitted functions as a stopper section for a lowermost limit that defines the lowermost limit of the stroke of the push rod 6. More specifically, as shown in FIG. 15, at the lowermost limit of the stroke of the push rod 6, both ends of the pin 72 contact an upper end surface 9*a* of the cylinder 9 so that the push rod 6 cannot descend furthermore.

Figure 12:
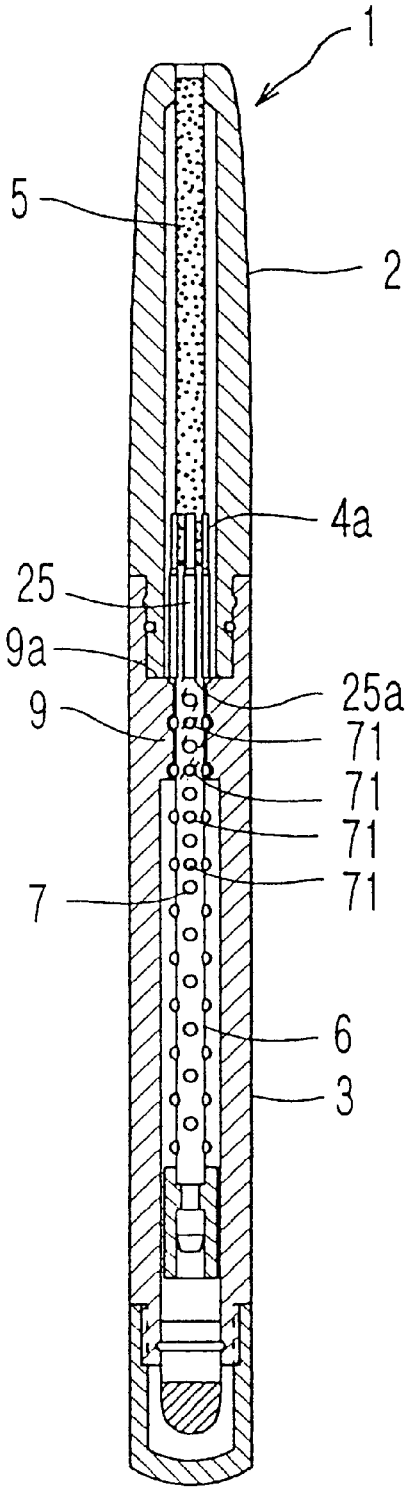
FIG. 12 is a sectional view showing a container according to a fourth embodiment.
Figure 13:
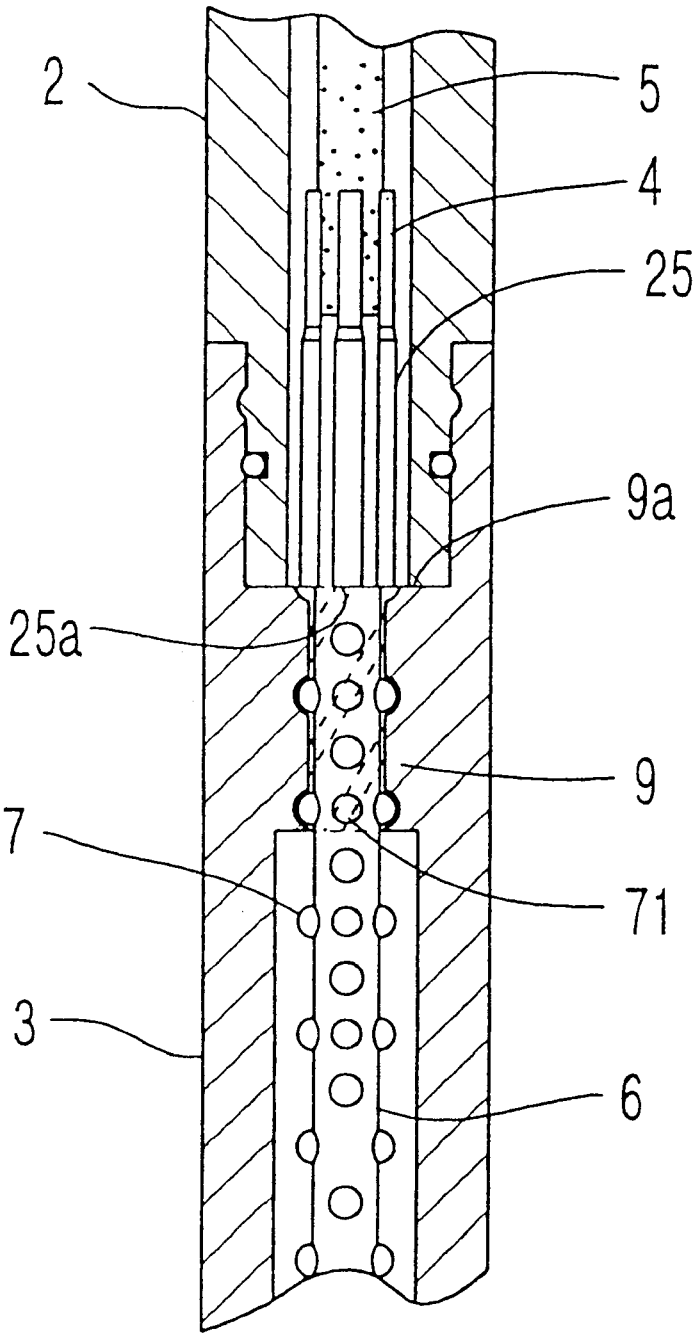
FIG. 13 is a partially sectional view showing an enlarged vicinity of a cylinder of the container.
Figure 14:
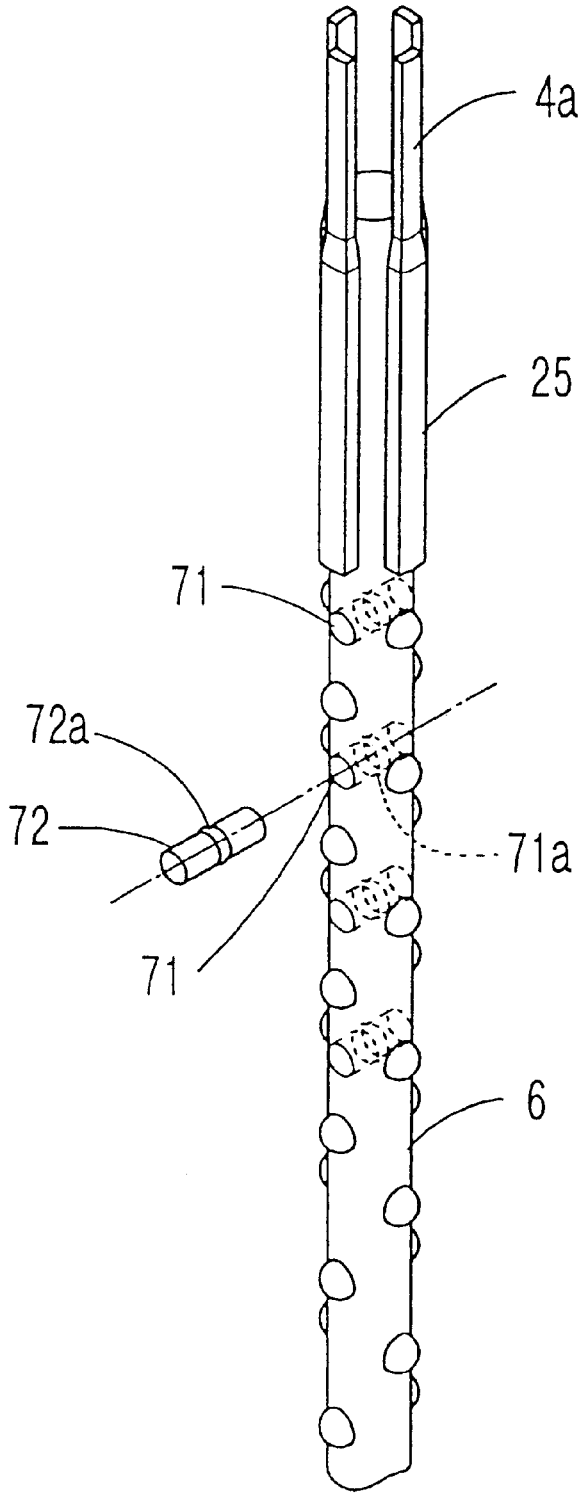
FIG. 14 is a perspective view showing a push rod and a pin.

Thus, a variety of lowermost limits of the stroke (length of the stroke) of the push rod 6 can be set according to the location of the pin 72. The lower the location of a pin hole selected is, the higher the location the push rod 6 at the lowermost limit of the stroke is, whereby length of the stroke of the push rod 6 becomes short. If the pin 72 is not fixed into any pinholes 71, as shown in FIGS. 12 and 13, a location where the lower end surface 25*a* of the streak 25 contacts the upper end surface 9*a* of the cylinder 9 will be the lowermost limit of the stroke. Thus, the feeding stroke can be changed without increasing the number of parts or exchanging the parts, whereby it is easy to cope with the cosmetic materials 5 of different length.

Incidentally, in each of the embodiments described above, it is arranged such that the number of the projections 7 or the claws 4*a* coincides with the number of the respective grooves 8 and grooves 11. The correspondence of the number like this is convenient for assembling and manufacturing. However, the present invention is not restricted to such embodiments. It is also preferable that the number of the projections 7 or the claws 4*a* is smaller than that of the respective grooves 8 and grooves 11.

The entire contents of Japanese Patent Application P10-232391 (filed Aug. 5, 1998) are incorporated herein by reference. Although the invention has been described above by reference to certain embodiments of the invention, the invention is not limited to the embodiments described above. Modifications and variations of embodiments described above will occur to those skilled in the art, in light of the above teaching.

The scope of the invention is defined with reference to the following claims.

What is claimed is:

1. A container for feeding a stick type cosmetic material comprising:

a front cylinder in which a stick type cosmetic material is housed in such a manner that the material can advance and retract and a plurality of longitudinal grooves are formed on its inner surface;

a main body of the container to be rotatably connected to the front cylinder;

a push rod, which has at its front end a plurality of claws capable of sliding in said grooves, for holding said stick type cosmetic material;

a spiral cylinder, non-rotatably provided in said main body of the container, in which said push rod runs through in a state of being spirally engaged;

a plurality of projections which are spirally engaged with spiral grooves provided on an inner surface of said spiral cylinder and provided at an outer circumference of said push rod in such a manner that the projections are lined up below said claws;

a whirl-stop mechanism for engaging said longitudinal grooves with said projections which have advanced upward and got out of said spiral cylinder and stopping a whirl of said push rod and said front cylinder; and a stopper for defining an uppermost limit of a stroke of said push rod by contacting, in the vicinity of a lower end of said push rod, a lower end surface of said spiral cylinder.

2. The container for feeding a stick type cosmetic material according to claim 1, wherein a breadth of said claws is equal to or narrower than that of said projections.

3. The container for feeding a stick type cosmetic material according to claim 1, wherein said spiral cylinder is provided separately from said main body of the container, also said push rod is run through said spiral cylinder so as to form a unit which is sandwiched between a side of said claws and a side of said stopper, and the unit is fitted to said main body of the container and said front cylinder.

4. The container for feeding a stick type cosmetic material according to claim 1, wherein length of the longitudinal grooves of said front cylinder is longer than that of a stroke of said push rod.

5. The container for feeding a stick type cosmetic material according to claim 1, wherein said stopper is a bend piece which defines an uppermost limit of a stroke of said push rod and is formed at a determined location on a lower end side of said push rod, and the bend piece permits said spiral cylinder to run through from a lower end side.

6. The container for feeding a stick type cosmetic material according to claim 1, wherein a lower end of said stopper contacts a bottom surface of the main body of the container.

7. The container for feeding a stick type cosmetic material according to claim 1, wherein a stopper section for a lowermost limit is provided at a location where said push rod has advanced upward and got out of said spiral cylinder, and the stopper section for a lowermost limit contacts an upper end of said spiral cylinder.

8. The container for feeding a stick type cosmetic material according to claim 7, wherein a plurality of streaks to be engaged with said longitudinal grooves are provided below said plurality of claws, respectively, and also a lower end section of these streaks is said stopper section for a lowermost limit.

9. The container for feeding a stick type cosmetic material according to claim 7, wherein a pin to be removably fixed into a pin hole which horizontally penetrates said push rod is provided as said stopper section for a lowermost limit.

* * * * *

UNITED STATES PATENT AND TRADEMARK OFFICE

CERTIFICATE OF CORRECTION

PATENT NO. : 6,048,122
DATED : April 11, 2000
INVENTOR(S) : Atsushi Ohba

It is certified that error appears in the above-identified patent and that said Letters Patent is hereby corrected as shown below:

Drawings,
Substitute Fig. 1 below for Fig. 1 below:

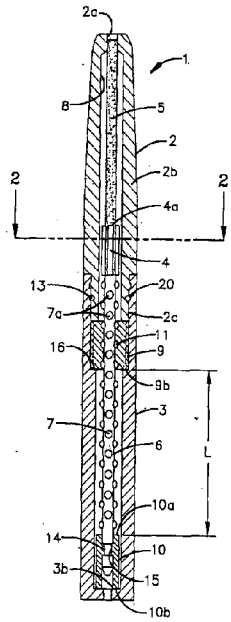

FIG-1

Signed and Sealed this

Twenty-seventh Day of May, 2003

JAMES E. ROGAN
*Director of the United States Patent and Trademark Office*